US006058900A

United States Patent [19]

Kusche et al.

[11] Patent Number: 6,058,900

[45] Date of Patent: May 9, 2000

[54] INTERNAL COMBUSTION ENGINE WITH IMPROVED CYLINDER WALL LUBRICATION SYSTEM

[75] Inventors: David W. Kusche; Neil M. Andrasko, both of Oshkosh, Wis.

[73] Assignee: Brunswick Corporation, Lake Forest, Ill.

[21] Appl. No.: 09/356,686

[22] Filed: Jul. 20, 1999

[51] Int. Cl.[7] ..... F01M 1/04

[52] U.S. Cl. ..... 123/196 CP; 123/196 R; 123/196 W

[58] Field of Search ..... 123/70 R, 196 R, 123/196 CP, 196 W; 184/6.8

[56] References Cited

U.S. PATENT DOCUMENTS

| | | | |
|---|---|---|---|
| 2,326 | 1/1841 | Rogers | 123/70 R |
| 2,136,293 | 11/1938 | Gentry | 123/70 R |
| 2,556,273 | 6/1951 | Hedges | 184/18 |
| 4,672,931 | 6/1987 | Biagini | 123/193 |
| 4,993,380 | 2/1991 | Hsu | 123/193 |
| 5,611,302 | 3/1997 | Duvinage | 123/65 |

*Primary Examiner*—Marguerite McMahon
*Assistant Examiner*—Katie B. Harris
*Attorney, Agent, or Firm*—William D. Lanyi

[57] ABSTRACT

An internal combustion engine is provided with fluid passages between adjacent cylinders. The fluid passages extend through walls that separate adjacent cylinders and are located axially within the cylinders at positions which advantageously define the periods when the fluid passages are blocked and unblocked by pistons moving within lower cylinders. Pressure differentials between adjacent crankcases cause pooled liquid lubricant to be pumped downward through the fluid passages and placed in liquid communication with the walls of the lower cylinder. This pumping action removes pooled lubricant from the transfer passages of one cylinder and causes the liquid lubricant to flow along the walls of a lower cylinder.

17 Claims, 4 Drawing Sheets

INTERNAL COMBUSTION ENGINE WITH IMPROVED CYLINDER WALL LUBRICATION SYSTEM

Background of the Invention

1. Field of the Invention

The present invention is generally related to an internal combustion engine lubrication system and, more particularly, to a lubrication system that pumps pooled oil from the collection location of one cylinder, through an inter-cylinder wall, and into an adjacent cylinder.

2. Description of the Prior Art

Internal combustion engines have been known for many years, including lubrication systems for preventing damage due to wear between sliding surfaces.

U.S. Pat. No. 2,556,273, which issued to Hedges on Jun. 12, 1951, describes an internal combustion engine cylinder lubrication system. It relates generally to internal combustion engines and, more particularly, to an improved means for supplying a constant and uniform flow of lubricating oil to the internal wall surfaces of the piston cylinders to lubricate the pistons during the reciprocation within their respective cylinders. The system is auxiliary to the oil rings conventionally fitted upon the piston.

U.S. Pat. No. 4,672,931, which issued to Biagini on Jun. 16, 1987, describes a lubrication system with oil recovery for a two-stroke engine piston with a sump pump for scavenging. The lubrication system with oil recovery for a two-stroke engine piston consists of a lubricating oil pressure circulation system having inlet and outlet holes for the oil. The holes pass through the wall of the cylinder. It further comprises shaped scraper rings, each ring being housed within a circular housing or seat obtained on the outside skirt of the piston. The circular housings are provided on the skirt of the piston at a height which does not allow any overlapping on the scraper rings on the transfer ports of the two-stroke engine.

U.S. Pat. No. 4,993,380, which issued to Hsu on Feb. 19, 1991, describes a lubrication mechanism for an engine cylinder. The mechanism includes upper and lower ring troughs on the inside wall of the engine cylinder. The two ring troughs can accommodate oil pipes and ring oil nets. The oil pipes includes an inlet pipe and an outlet pipe. Channels and numerous oil pores are defined by the pipes to allow the entrance of lubricating oil into the oil pipes, and seepage from the pores on the oil pipe, through a ring oil net to provide lubrication to the inside wall of the cylinder. The lubricating oil then flows downwardly to the lower ring oil net, through the net and the oil pipe, and into an outlet pipe for discharge.

U.S. Pat. No. 5,611,302, which issued to Duvinage et al on Mar. 18, 1997, describes a two cycle internal combustion engine with unidirectional flow scavenging. In a two cycle internal combustion engine with unidirectional flow scavenging, a piston is disposed in a cylinder so as to movable between top and bottom dead center end positions, the cylinder has fresh air inlet passages which are so arranges to that their bottom walls are disposed below the piston top edge when the piston is at its bottom dead center position so that part of the piston top land is directly exposed to the fresh air through the air inlet passages and oil discharge bores extend from the air inlet passages and are in communication with the oil circulating system for the removal of oil wiped off the cylinder wall and collected in the inlet passages.

As is known to those skilled in the art, internal combustion engines used in outboard motor applications are typically arranged so that the crankshaft's axis of rotation is generally vertical. This places the cylinders in one or more vertical rows, depending on the number of cylinders in the engine. The vertical arrangement of the cylinders can create several problems.

One problem faced by internal combustion engines, particularly those used in marine applications, is that the cylinder walls are sometimes difficult to lubricate properly. It is important to provide lubrication on the cylinder walls to prevent excessive wear because of the sliding contact between the piston rings and the cylinder wall. Another problem faced by internal combustion engines used in marine applications is the pooling of lubricant at certain collection locations. In order to properly lubricate the sliding surfaces of an internal combustion engine, it is beneficial to cause the lubricant, such as oil, to flow along the surfaces toward locations where two surfaces slide on one another or, alternatively, to spray a lubricant mist on these potential wear surfaces. When lubricant pools within the crankcases or cylinders of an engine, the pooled, or puddled, lubricant does not fulfill a useful function. In addition, pooled lubricant is often drawn into the combustion chamber and burned. This can create excessive smoke in the exhaust.

It would therefore be significantly beneficial if a lubrication system could be developed that both improved the lubrication of the cylinder walls and avoided excessive pooling of lubricant in puddles.

SUMMARY OF THE INVENTION

An internal combustion engine made in accordance with the present invention comprises a first cylinder formed in an engine block and a first piston disposed in the first cylinder for reciprocating motion therein. A first crankcase is connected in fluid communication with the first cylinder and a first pressure within the first crankcase has a first magnitude which varies in response to the reciprocating motion of the first piston within the first cylinder.

It further comprises a second cylinder and a second piston disposed within the second cylinder for reciprocating motion therein. A second crankcase is connected in fluid communication with the second cylinder and a second pressure within the second crankcase has a second magnitude which varies in response to the reciprocating motion of the second piston within the second cylinder.

A wall separates the first and second cylinders, which are adjacent to each other. A fluid passage is formed through the wall with the fluid passage being alternatively blocked and unblocked by the second piston as the second piston moves in reciprocating motion within the second cylinder. The fluid passage is unblocked for at least a portion of a period of time when the first magnitude exceeds the second magnitude in order to allow a fluid to pass through the fluid passage from the first cylinder into the second cylinder. The fluid passing through the fluid passage is a mixture of liquid lubricant, such as oil, and pressurized air. The difference between the first and second magnitudes of pressure induces the flow of this fluid from the first cylinder to the second cylinder.

The fluid passage can be disposed at a lubrication collection location within the first cylinder. This lubrication collection location can be a transfer passage of the first cylinder.

In certain embodiments of the present invention, it is highly beneficial to assure that the fluid passage is blocked by the second piston at all times when the second magnitude exceeds the first magnitude. Otherwise, the higher second magnitude could force a reverse flow through the fluid passage in the direction from the second cylinder toward the first cylinder. In most applications of the present invention, this reverse flow is disadvantageous and is avoided by blocking the fluid passage with the second piston when the second magnitude exceeds the first magnitude. This is accomplished by advantageously selecting the location of the fluid passage so that it is blocked at all times when the second magnitude exceeds the first magnitude.

In a particularly preferred embodiment of the present invention, the fluid passage intersects the second cylinder at a location that results in the fluid passage remaining continuously unblocked by the second piston during the travel of the second piston from 37° before top dead center (BTDC) through 37° after top dead center (ATDC). The present invention can be used in a six cylinder engine, particularly a V-6 engine that is arranged with three cylinders arranged in each of two parallel rows.

As will be described in greater detail below, a top cylinder of three cylinders provides a fluid flow through a fluid passage into the cylinder immediately below it. This cylinder which receives oil from the top cylinder provides a lubricant flow through a fluid passage into a lower cylinder. In a typical application of the present invention, within a V-6 engine, a number 1 cylinder is on top, a number 3 is in the middle, and a number 5 cylinder is at the bottom. In the other row of three cylinder of the V-6 engine, the number 2 cylinder is on top, the number 4 cylinder is below the number 2 cylinder, and the number 6 cylinder is at the bottom below the number 4 cylinder.

Although the present invention is particularly useful in certain types of engines, it should be understood that it can be employed to improve lubrication in any engine that has two or more cylinders.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
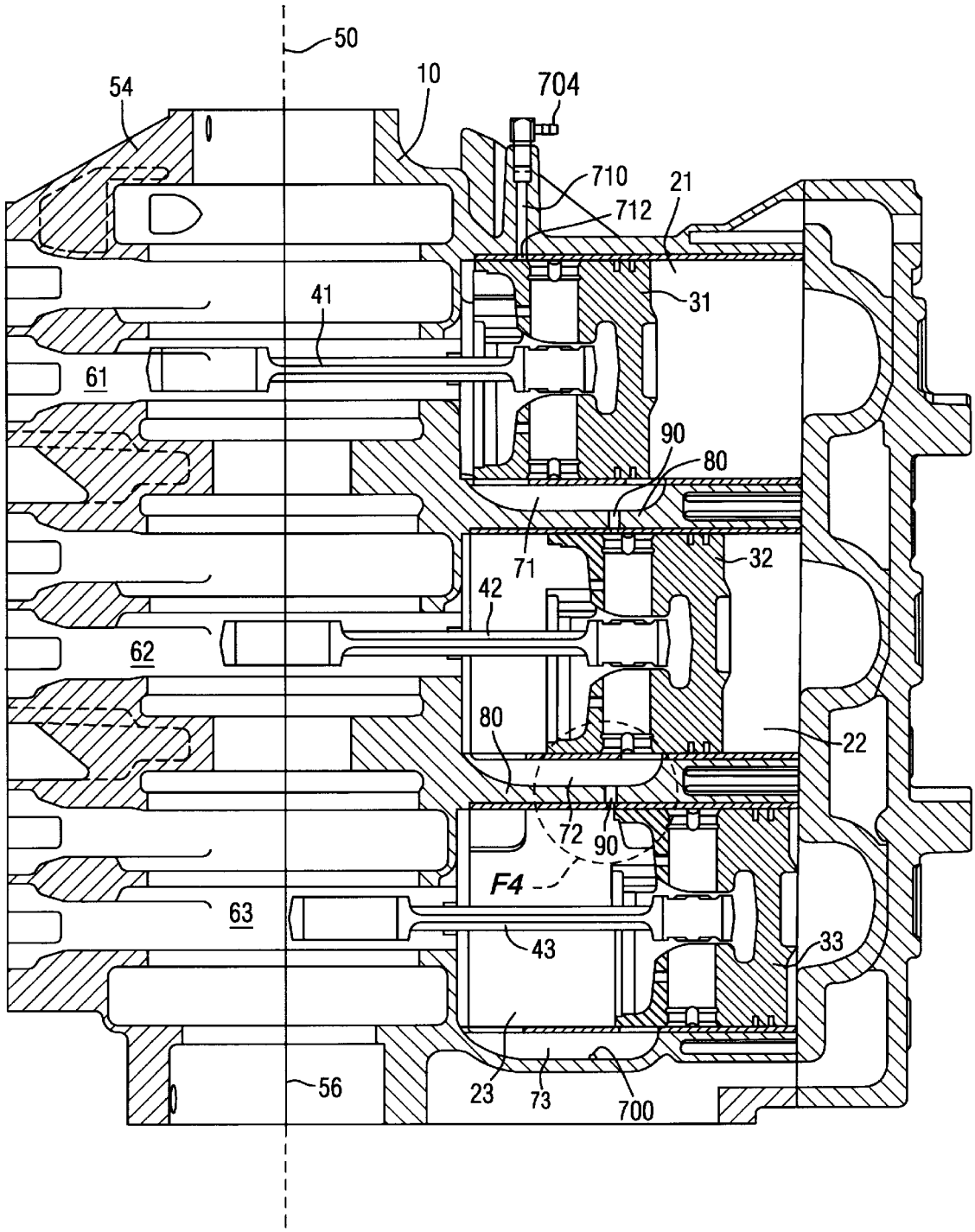
FIG. 1 is a section view of one row of three cylinders of a V-6 internal combustion engine.

Throughout the description of the preferred embodiment, like components will be identified by like reference numerals.

FIG. 1 is a section view of an internal combustion engine which is taken through one row of three cylinders of a V-6 engine. As can be seen, the engine block 10 defines three cylinder, 21, 22, and 23. Three pistons, 31, 32, and 33, are shown disposed in their associated cylinders for reciprocating motion therein. Each piston has a connecting rod, 41, 42, and 43, which, in turn, is attached to a crankshaft (not shown in FIG. 1) that rotates about a rotational axis 50. A lower cover 54 is attached to the engine block 10 at parting line 56, to define three crankcase chambers, 61, 62, and 63.

With continued reference to FIG. 1, it can be seen that each cylinder has a transfer passage. These transfer passages, 71, 72, and 73, provide a fluid passage from a region below the associated piston to a region above the associated piston when the piston is within a certain range of travel within the cylinder. This allows pressurized gases to flow from the crankcase chamber into the combustion chamber by passing around the length of the piston and through the transfer passage, from left to right in FIG. 1.

The present invention will be described in greater detail below in conjunction with a particular internal combustion engine in which the pistons are reciprocating 120° out of phase with each other. Although this arrangement is common, it is not necessary in all applications of the present invention.

As the pistons, 31–33, move in a reciprocating motion within their respective cylinders, 21–23, the magnitude of the pressure within their respective crankcases, 61–63, fluctuates in response to the reciprocating movement of the associated piston. As the piston moves toward its top dead center (TDC) position toward the right in FIG. 1, it decreases the pressure within the crankcase and causes air to be drawn into the crankcase through reed valves (not shown in FIG. 1) in a manner that is generally well known to those skilled in the art. After reaching its top dead center (TDC) position, the piston then begins to move toward the left in FIG. 1 and toward its bottom dead center (BDC) position. It decreases the total volume of the combined crankcase and cylinder region and, as a result, increases the pressure is within its crankcase.

Figure 2:
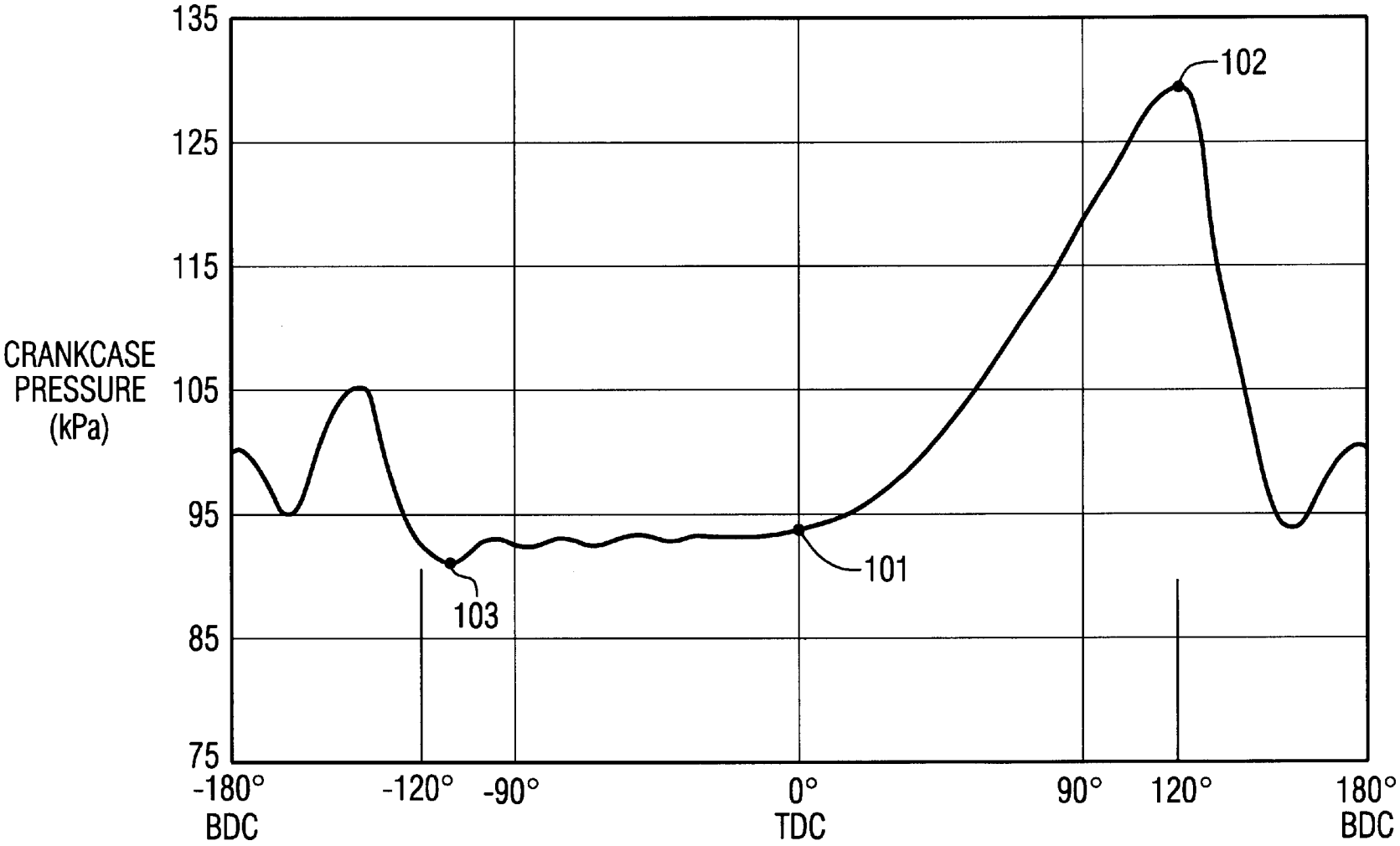
FIG. 2 is a graphical representation of a pressure profile within a crankcase of an internal combustion engine.

FIG. 2 is a graphical representation of a typical crankcase pressure, measured in kilopascals. Each kilopascal is equivalent to 1,000 newtons per square meter. The horizontal axis in FIG. 2 represents the piston position measured with respect to the angular position of the crankshaft. Beginning at point 101, when the piston is at its top dead center (TDC) position, the crankcase pressure begins to rise as the piston moves toward its bottom dead center position (toward the left in FIG. 1). This rise is generally continuous until the piston reaches a position, at approximately 120° after top dead center (ATDC) when it is at a position that allows the crankcase gases to flow through a transfer passage from below the piston to the combustion chamber above the piston. With reference to FIG. 1, the top piston 31 is almost at the leftmost extreme of that position. In other words, if piston 31 were moved slightly toward its top dead center (TDC) position, its transfer passage 71 would freely allow pressurized gas to flow from the crankcase 61 to the cylinder 21 above the piston 31. This results in a rapid decrease in the pressure of the crankcase. This pressure decrease occurs between points 102 and 103 in FIG. 2. Point 103 in FIG. 2 coincides with the closing of the transfer passage. The graphical representation in FIG. 2 shows the total pressure profile of a crankcase as a function of the position of the piston for one complete rotation of the crankshaft.

With reference to FIGS. 1 and 2, it can be seen that the rotation of the crankshaft causes the reciprocating motions of the pistons within their respective cylinders. These reciprocating motions cause the respective crankcases to experience pressure changes represented graphically in FIG. 2. However, the pistons are not in phase with each other. Therefore, the instantaneous pressures within the crankcases, 61–63, will vary from crankcase to crankcase, as a function of the relative positions of their respective pistons.

With reference to FIG. 1, it can be seen that a wall 80 separates the adjacent cylinders. One wall 80 separates the top cylinder 21 from the middle cylinder 22 and another wall 80 separates the middle cylinder 22 from the bottom cylinder 23. It can also be seen that each of these walls 80 is provided with a fluid passage 90 extending through it. In a particular preferred embodiment of the present invention, the fluid passage 90 intersects the transfer passage, 71 or 72, of the cylinder above the wall. In addition, it can be seen that the fluid passage is alternatively blocked an unblocked by the piston below the fluid passage 90. As the pistons move in their reciprocated motion, they alternately block and unblock the fluid passages 90 extending toward their respective cylinders from the cylinder above. For example, in FIG. 1, the fluid passage 90 extending downward toward the bottom cylinder 23 is unblocked because the piston 33 is located sufficiently toward its top dead center (TDC) position. However, the fluid passages 90 through wall 80 extending downward toward the middle cylinder 22 is blocked because piston 32 has moved from its top dead center (TDC) position, toward the left in FIG. 1, and blocked it.

It can be seen that if a pressure differential exists across any one of the fluid passages 90 and the piston below the fluid passage 90 is not blocking the fluid passage, fluid will be induced to flow through the fluid passage 90. It can also be seen that, since the fluid passages 90 intersect the transfer passages above them, any liquid collecting in a pool within the transfer passages will be forced through the fluid passages 90 if the upper cylinder is at a pressure magnitude greater than the lower cylinder.

Figure 4:
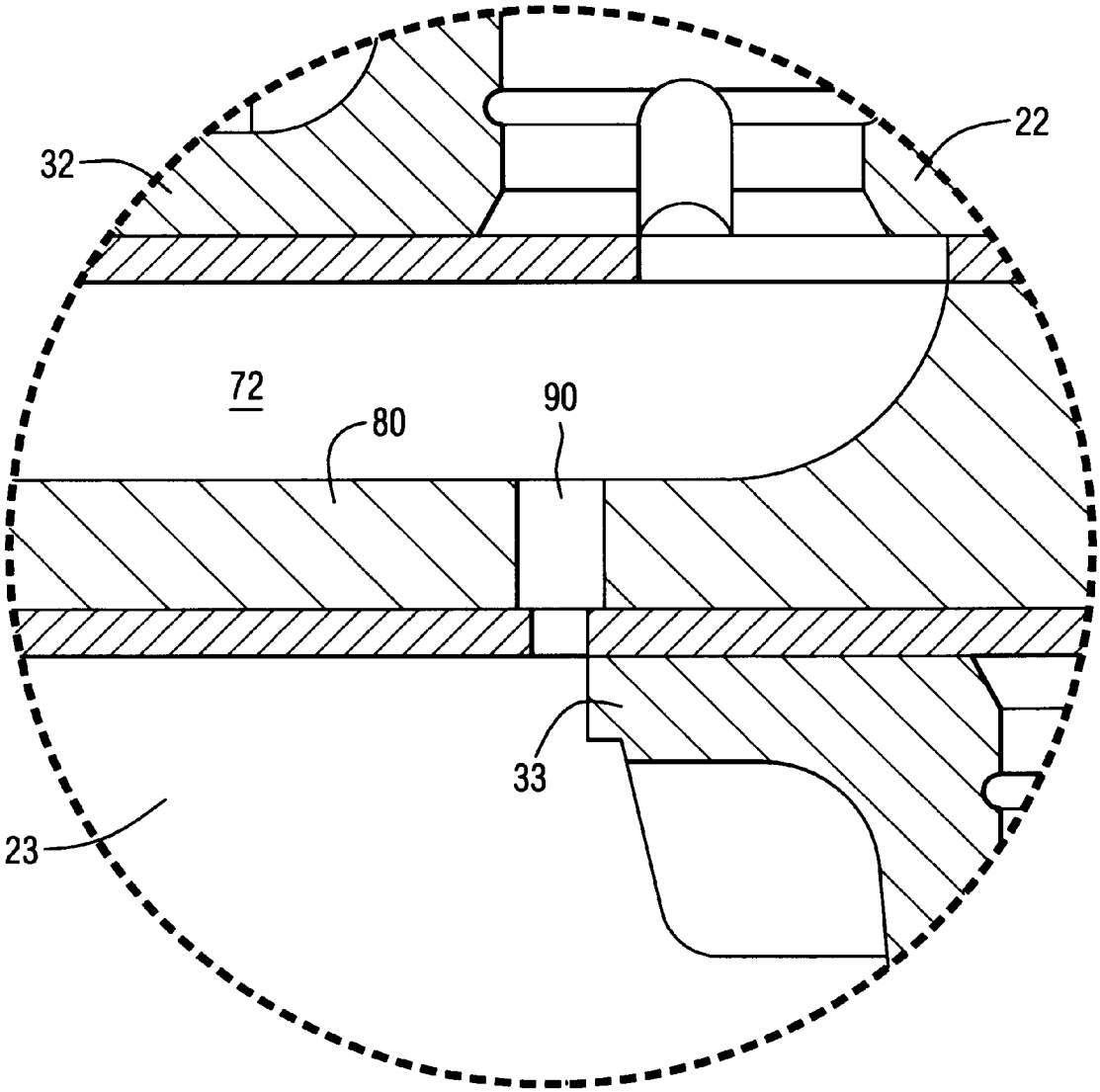
FIG. 4 is an enlarged view of a portion of FIG. 1.

The portion of FIG. 1 contained within the circular dashed line F4 is shown in an enlarged view in FIG. 4. With reference to FIGS. 1 and 4, it can be seen that any liquid collecting in a pool within the transfer passage 72 will be forced downward through the fluid passage 90 into the lower cylinder 23 if the fluid passage 90 is unblocked by piston 33 and if the pressure within the transfer passage 72 is greater than the pressure within the portion of cylinder 23 below the piston 33. It should be understood that the pressure below the piston 33 within cylinder 23 is generally identical to magnitude to the pressure of crankcase 63.

Figure 3:
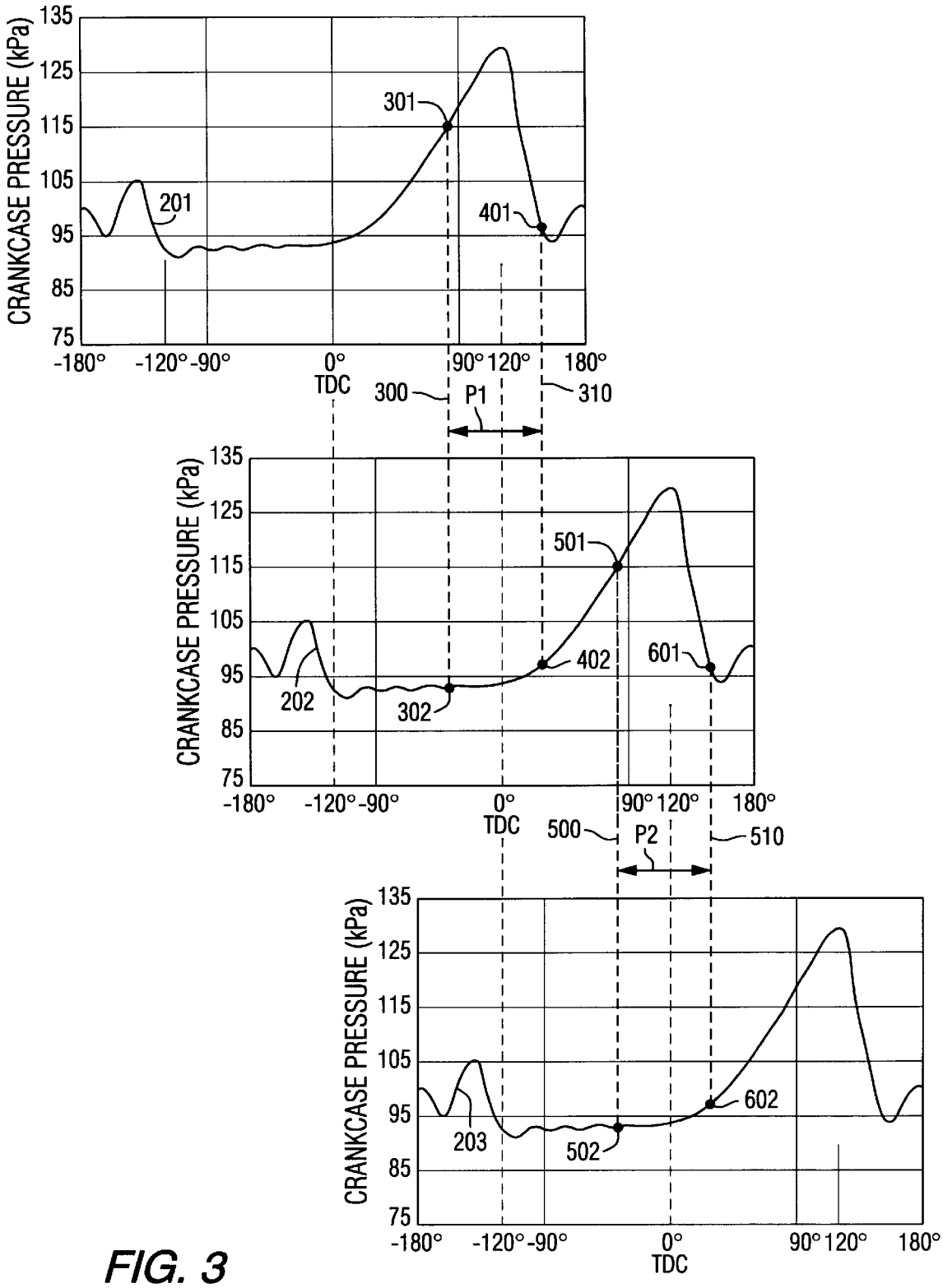
FIG. 3 shows three pressure profiles of the three cylinders illustrated in FIG. 1.

FIG. 3 is a composite of three graphical segments representing the pressure profiles of the three crankcases shown in FIG. 1. The three pistons causing the pressure profiles in FIG. 3 are out of phase with each other by a magnitude of 120° of crankshaft rotation. Therefore, when the top piston 31 is creating the crankcase pressure profile 201, the middle piston 32 is at a position 120° before top dead center (TDC) and creating the pressure profile 202 in FIG. 3. The bottom piston 33 creates the crankcase pressure profile 203 and is 120° behind the middle piston 32. The dashed vertical lines in FIG. 3 identify common points in time for the three pressure profiles. For example, at the time represented by dashed line 300, the top crankcase 61 is at a pressure of approximately 115 kilopascals at the same time that the middle crankcase 62 is at a pressure slightly less than 95 kilopascals. These pressure magnitudes have been empirically determined to be 118 kilopascals and 93 kilopascals, respectively. Therefore, at the time identified by dashed line 300, a pressure differential of 25 kilopascals exists between the top crankcase 61 and the middle crankcase 62. Therefore, if the lower piston 32 unblocks the fluid passage 90 extending through the wall 80 between the top cylinder 21 and the middle cylinder 22 during the region of time represented by arrow P1, fluid will be forced to flow downward from the top transfer passage 71 into the middle cylinder 22. This pressure differential will exist for the period identified as P1 in FIG. 3 until the time identified by dashed line 310 when the two pressures are equal. In other words, the pressure represented by point 401 in the top crankcase 61 is equal to the pressure represented by point 402 in the middle crankcase 62.

With continued reference to FIG. 3, the same basic principles are employed to cause a flow of fluid through the fluid passage 90 in the wall 80 between the middle cylinder 22 and the bottom cylinder 23. This flow occurs between dashed lines 500 and 510, during the period identified as P2. Because the pressure represented by point 501 in the middle crankcase 62 is greater than the pressure represented by point 502 in the bottom crankcase 63, a pressure differential causes fluid to flow downward through the fluid passage 90 in the wall 80 between the middle and bottom cylinders, 22 and 23 respectively.

By appropriately locating the fluid passage 90 along the length of the cylinder wall, the period of time when the fluid passage 90 remains unblocked by its associated piston can be advantageously selected. In one particular application of the present invention, the fluid passages 90 are located at an axial position along the cylinder wall that coincides with the bottom edge of the piston skirt when the piston is at a position of approximately 37° of crankshaft rotation from the top dead center (TDC) position of the piston. As a result, the piston skirt unblocks the fluid passage 90 at a position of 37° before top dead center (BTDC) and leaves the fluid passage 90 unblocked until it reaches its top dead center (TDC) and continues to the position of 37° after top dead center (ATDC). With this arrangement, the fluid passage 90 remains unblocked only while the pressure within the upper transfer passage 71 is greater than the pressure in the lower crankcase 62. Similarly, the fluid passage 90 between the middle and bottom cylinders, remains unblocked by piston 33 only while the pressure in the transfer passage 72 is greater than the pressure in the lower crankcase 63. This arrangement facilitates the efficient pumping of pooled lubricant from the transfer passages, through the fluid passages, and into the cylinders below the fluid passages 90.

With reference to FIG. 1, it can be seen that cylinder 23 is the lowest cylinder in the row of cylinders. Therefore, the pooled lubricant in the transfer passage 73 can not be pumped into a lower cylinder. Therefore, a lubricant aperture 700 is provided in the lowest transfer passage 73. The lubricant aperture 700 can then be connected to a conduit, such as a plastic tube, and conducted upward to the barbed fitting of nipple 704 of a check valve which is attached to the engine block 10 and disposed in fluid communication with a fluid passage 710 that leads to an opening 712 in the cylinder wall of the uppermost cylinder 21. In conjunction with the check valve which limits fluid flow through the conduit to an upward direction, the pressure differential between the transfer passage 73 and the upper crankcase 61 is such that the liquid lubricant pooled in the lowest transfer passage 73 can be pumped up to the nipple 704 by the differential pressures.

As can be seen, the present invention solves two problems relating to internal combustion engines. First, it pumps liquid lubricant to the walls of the cylinders to improve the lubrication between the cylinder walls and the piston rings. Secondly, the present invention removes pooled liquid lubricant from the transfer passages where it would serve no other useful purpose. Instead of causing the liquid lubricant to be forced from the transfer passages into the combustion chambers of the associated cylinders, the present invention removes the pooled lubricant from the transfer passages and pumps it downward through the fluid passages into the cylinder below where it can provide the useful lubrication of the cylinder walls.

Although the present invention has been described with particular specificity in regard to a V-6 engine, it should be understood that any engine with two or more cylinders can benefit from the present invention. In addition, the fluid passages are described as being located at particular locations relative to the travel of the pistons, but it should be understood that alternative locations are also suitable and within the scope of the present invention.

We claim:

1. An internal combustion engine, comprising:

a first cylinder formed in an engine block;

a first piston disposed in said first cylinder for reciprocating motion therein;

a first crankcase connected in fluid communication with said first cylinder, a first pressure within said first crankcase having a first magnitude which varies in response to said reciprocating motion of said first piston within said first cylinder;

a second cylinder formed in said engine block, said second cylinder being disposed below said first cylinder during normal operation of said engine;

a second piston disposed in said second cylinder for reciprocating motion therein;

a second crankcase connected in fluid communication with said second cylinder, a second pressure within said second crankcase having a second magnitude which varies in response to said reciprocating motion of said second piston within said second cylinder;

a wall disposed between said first and second cylinders; and a fluid passage formed through said wall, said fluid passage being alternately blocked and unblocked by said second piston as said second piston moves in said reciprocating motion within said second cylinder, said fluid passage being unblocked for at least a portion of a period of time when said first magnitude of said first pressure within said first crankcase exceeds said second magnitude of said second pressure within said second crankcase to allow a fluid to pass through said fluid passage from said first cylinder into said second cylinder.

2. The engine of claim 1, wherein:

said fluid passage is disposed at a lubrication collection location within said first cylinder.

3. The engine of claim 2, wherein:

said fluid passage intersects with a transfer passage of said first cylinder.

4. The engine of claim 1, wherein:

said fluid passage is blocked by said second piston at all times when said second magnitude exceeds said first magnitude.

5. The engine of claim 1, wherein:

said fluid passage intersects said second cylinder at a location that results in said fluid passage remaining continuously unblocked by said second piston during the travel of said second piston from 37 degrees before top dead center through 37 degrees after top dead center.

6. The engine of claim 1, wherein:

said engine is a six cylinder engine.

7. The engine of claim 6, wherein:

said engine is a V-6 engine with three cylinders arranged in two parallel rows, with three cylinders in each of said two parallel rows.

8. An internal combustion engine, comprising:

a first cylinder formed in an engine block;

a first piston disposed in said first cylinder for reciprocating motion therein;

a first crankcase connected in fluid communication with said first cylinder, a first pressure within said first crankcase having a first magnitude which varies in response to said reciprocating motion of said first piston within said first cylinder;

a second cylinder formed in said engine block, said second cylinder being disposed below said first cylinder during normal operation of said engine;

a second piston disposed in said second cylinder for reciprocating motion therein;

a second crankcase connected in fluid communication with said second cylinder, a second pressure within said second crankcase having a second magnitude which varies in response to said reciprocating motion of said second piston within said second cylinder;

a wall disposed between said first and second cylinders; and a fluid passage formed through said wall, said fluid passage being alternately blocked and unblocked by said second piston as said second piston moves in said reciprocating motion within said second cylinder, said fluid passage being unblocked for at least a portion of a period of time when said first magnitude of said first pressure within said first crankcase exceeds said second magnitude of said second pressure within said second crankcase to allow a fluid to pass through said fluid passage from said first cylinder into said second cylinder, said fluid passage intersecting a transfer passage of said first cylinder.

9. The engine of claim 8, wherein:

said transfer passage operates as a lubrication collection location within said first cylinder.

10. The engine of claim 9, wherein:

said fluid passage is blocked by said second piston at all times when said second magnitude exceeds said first magnitude.

11. The engine of claim 10, wherein:

said fluid passage intersects said second cylinder at a location that results in said fluid passage remaining continuously unblocked by said second piston during the travel of said second piston from 37 degrees before top dead center through 37 degrees after top dead center.

12. The engine of claim 11, wherein:

said engine is a six cylinder engine.

13. The engine of claim 12, wherein:

said engine is a V-6 engine with three cylinders arranged in two parallel rows, with three cylinders in each of said two parallel rows.

14. An internal combustion engine, comprising:

a first cylinder formed in an engine block;

a first piston disposed in said first cylinder for reciprocating motion therein;

a first crankcase connected in fluid communication with said first cylinder, a first pressure within said first crankcase having a first magnitude which varies in response to said reciprocating motion of said first piston within said first cylinder;

a second cylinder formed in said engine block, said second cylinder being disposed below said first cylinder during normal operation of said engine;

a second piston disposed in said second cylinder for reciprocating motion therein;

a second crankcase connected in fluid communication with said second cylinder, a second pressure within said second crankcase having a second magnitude which varies in response to said reciprocating motion of said second piston within said second cylinder;

a wall disposed between said first and second cylinders; and a fluid passage formed through said wall, said fluid passage being alternately blocked and unblocked by said second piston as said second piston moves in said reciprocating motion within said second cylinder, said fluid passage being unblocked for at least a portion of a period of time when said first magnitude of said first pressure within said first crankcase exceeds said second magnitude of said second pressure within said second crankcase to allow a fluid to pass through said fluid passage from said first cylinder into said second cylinder, said fluid passage intersecting a transfer passage of said first cylinder, said fluid passage being blocked by said second piston at all times when said second magnitude exceeds said first magnitude.

15. The engine of claim 14, wherein:

said transfer passage operates as a lubrication collection location within said first cylinder and said fluid passage intersects said second cylinder at a location that results in said fluid passage remaining continuously unblocked by said second piston during the travel of said second piston from 37 degrees before top dead center through 37 degrees after top dead center.

16. The engine of claim 15, wherein:

said engine is a six cylinder engine.

17. The engine of claim 16, wherein:

said engine is a V-6 engine with three cylinders arranged in two parallel rows, with three cylinders in each of said two parallel rows.

* * * * *